US008596760B2

(12) United States Patent
Nihei

(10) Patent No.: US 8,596,760 B2
(45) Date of Patent: Dec. 3, 2013

(54) DROPLET EJECTION HEAD AND METHOD OF MANUFACTURING DROPLET EJECTION HEAD

(75) Inventor: Yasukazu Nihei, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 7 days.

(21) Appl. No.: 13/281,132

(22) Filed: Oct. 25, 2011

(65) Prior Publication Data

US 2012/0098896 A1 Apr. 26, 2012

(30) Foreign Application Priority Data

Oct. 26, 2010 (JP) ..... 2010-240008

(51) Int. Cl.
*B41J 2/14* (2006.01)

(52) U.S. Cl.
USPC ..... 347/47; 347/45; 347/64; 347/44

(58) Field of Classification Search
USPC ..... 347/47, 45, 64, 44
See application file for complete search history.

(56) References Cited

U.S. PATENT DOCUMENTS 6,511,156 B1 * 1/2003 Kazama et al. ..... 347/47

FOREIGN PATENT DOCUMENTS

| | | | |
|---|---|---|---|
| JP | 6-122204 | A | 5/1994 |
| JP | 11-240153 | A | 9/1999 |
| JP | 2000-226570 | A | 8/2000 |
| JP | 2000-229410 | A | 8/2000 |
| JP | 2004-276568 | * | 10/2004 |
| JP | 2009-66876 | A | 4/2009 |
| JP | 2009-107314 | A | 5/2009 |
| JP | 2009-113351 | A | 5/2009 |
| JP | 2010-18018 | A | 1/2010 |

* cited by examiner

*Primary Examiner* — Henok Legesse
(74) *Attorney, Agent, or Firm* — Birch, Stewart, Kolasch & Birch, LLP

(57) ABSTRACT

A droplet ejection head includes: a nozzle plate which has a nozzle aperture for ejecting droplets of liquid; a flow channel structure including a pressure chamber which contains the liquid and is connected to the nozzle aperture through a flow channel; and a pressure generating element which applies pressure to the liquid in the pressure chamber, wherein an ejection surface of the nozzle plate where the droplets of the liquid are ejected is made of a fluorine-containing DLC film.

6 Claims, 9 Drawing Sheets

| FLUORINE AMOUNT IN F-DLC FILM (at.%) | CONTACT ANGLE OF INK (DEGREE) |
|---|---|
| 0 | 45 |
| 10 | 56 |
| 20 | 65 |
| 30 | 73 |
| 40 | 80 |

| AMOUNT OF ADDED HYDROGEN IN F-DLC FILM SURFACE (at.%) | WIPING DURABILITY (NUMBER OF TIMES) |
|---|---|
| 10 | 20000 |
| 20 | 20000 |
| 35 | 28000 |

DROPLET EJECTION HEAD AND METHOD OF MANUFACTURING DROPLET EJECTION HEAD

BACKGROUND OF THE INVENTION

1. Field of the Invention

The present invention relates to a droplet ejection head and a method of manufacturing a droplet ejection head, and more particularly to a droplet ejection head and a method of manufacturing a droplet ejection head in which liquid repelling properties are imparted to a droplet ejection surface.

2. Description of the Related Art

In a droplet ejection head used in an image forming apparatus, or the like, when droplets have adhered to the surface of a nozzle plate, the adhering droplets affect droplets succeedingly ejected from the nozzles, and thereby variation may occur in the ejection directions of the succeeding droplets. It is then difficult to deposit the ejected droplets at prescribed positions on a recording medium and this causes deterioration of image quality. In order to prevent droplets from adhering to the surface of the nozzle plate, various methods for imparting water repelling properties to the surface of the nozzle plate have been proposed.

For example, Japanese Patent Application Publication No. 2000-229410 discloses that a water repelling function is imparted by forming a protruding and recessing structure on a surface of a substrate. However, if an un-structured flat surface does not have water repelling properties, then even if the protruding and recessing structure is subsequently foamed on the surface, no water repellence enhancing effect occurs. Hence, in general, the surface that has the protruding and recessing structure is coated with a water repelling film (see Japanese Patent Application Publication Nos. 2000-226570 and 06-122204).

On the other hand, when droplets have adhered to the surface of the nozzle plate, it is necessary to remove the droplets by wiping, or the like. Consequently, the durability, such as wear resistance, of the surface of the nozzle plate has to be improved. Therefore, a protruding and recessing structure is formed by means of a diamond-like carbon (DLC) film or a hard resin film (see Japanese Patent Application Publication Nos. 2009-113351, 2009-107314 and 2009-066876).

However, the water repelling films described in Japanese Patent Application Publication Nos. 2000-226570 and 06-122204 are thin films made from fluorine-containing organic silicon compounds, and hence there is a problem in that durability, principally the wear resistance, is poor. Furthermore, in the droplet ejection heads described in Japanese Patent Application Publication Nos. 2009-113351, 2009-107314 and 2009-066876, the surface that has the protruding and recessing structure is coated with a water repelling material or the protruding and recessing structure is made of a water repelling resin such that the water repelling properties are exhibited. Consequently, the protruding and recessing structure can be formed of a material of high durability, but since the outermost surface is made of the organic water repelling material, then significant improvement in the durability of the water repelling film is not observed.

SUMMARY OF THE INVENTION

The present invention has been contrived in view of these circumstances, an object thereof being to provide a droplet ejection head and a method of manufacturing a droplet ejection head whereby both mechanical durability and the durability of a liquid repelling function are simultaneously improved, and the slidability of the surface of a nozzle plate of a droplet ejection head is also improved with a view to improving wear resistance.

In order to attain the aforementioned object, the present invention is directed to a droplet ejection head, comprising: a nozzle plate which has a nozzle aperture for ejecting droplets of liquid; a flow channel structure including a pressure chamber which contains the liquid and is connected to the nozzle aperture through a flow channel; and a pressure generating element which applies pressure to the liquid in the pressure chamber, wherein an ejection surface of the nozzle plate where the droplets of the liquid are ejected is made of a fluorine-containing DLC film.

According to this aspect of the present invention, since the ejection surface of the nozzle plate is formed of the fluorine-containing DLC film, then it is possible to impart liquid repelling properties to the surface of the nozzle plate by including fluorine. Moreover, since the film is made of DLC, it is possible to form the film of high hardness and high strength, and therefore the mechanical durability can be improved. Furthermore, since the DLC film contains fluorine, then it is not necessary to coat the nozzle plate with an organic liquid repelling material as in the related art, and there is no reduction of the liquid repelling properties due to detachment of the liquid repelling material, thereby improving the durability of the liquid repelling function.

Preferably, a fluorine content of the fluorine-containing DLC film is not less than 30%.

According to this aspect of the present invention, the fluorine content in the fluorine-containing DLC film is set to be not less than 30%, it is thereby possible to obtain the nozzle plate having an effective liquid repelling function on the surface of the nozzle plate.

Preferably, the ejection surface of the nozzle plate has a protruding and recessing structure.

According to this aspect of the present invention, since the ejection surface of the nozzle plate has the protruding and recessing structure, then due to capillary action, no liquid can reach the bottom of the recessing sections, but rather air is left therein, and therefore it is possible to improve the liquid repelling function. For example, the contact angle of water with respect to air can be regarded as 180°, and therefore it is possible to achieve very high water repelling properties by leaving air in the recessing sections.

Preferably, the protruding and recessing structure has a dot shape with a dot size of 200 nm to 1 μm square and a dot pitch of 200 nm to 1 μm.

According to this aspect of the present invention, the shape and size of the protruding and recessing structure are set to the ranges described above, it is thereby possible to improve the liquid repelling function.

Preferably, the protruding and recessing structure is formed in the fluorine-containing DLC film.

According to this aspect of the present invention, since the protruding and recessing structure is formed in the fluorine-containing DLC film, then it is possible to improve the hardness and the strength of the protruding and recessing structure itself. Consequently, the mechanical strength can be improved without the protruding and recessing structure being destroyed by a wiping action, or the like.

Preferably, a hydrogen content in the fluorine-containing DLC film in protrusions in the protruding and recessing structure decreases from the ejection surface of the nozzle plate toward an interior of the nozzle plate.

If the hydrogen content in the fluorine-containing DLC film is small, then the ratio of $sp^3$ bonded carbon atoms of diamond structure is high, and therefore the density is high and the hardness and strength can be improved. If, conversely, the hydrogen content in the fluorine-containing DLC film is large, then the ratio of graphitic $sp^2$ bonded carbon atoms is high, and therefore the density is low, and the hardness and strength become weak, but the slidability can be improved. Therefore, according to this aspect of the present invention, by relatively increasing the hydrogen content in the fluorine-containing DLC film on the nozzle plate surface side thereof, slidability is improved and destruction of the protruding and recessing structure due to wiping, or the like, is prevented. Furthermore, by relatively reducing the hydrogen content in the fluorine-containing DLC film toward the interior of the nozzle plate, the mechanical strength of the protruding and recessing structure itself is improved. By this means, both the mechanical durability and the durability of the liquid repelling function are sufficiently achieved, and the wear resistance can be improved.

Preferably, the fluorine-containing DLC film has a laminated structure formed of a plurality of layers having different hydrogen contents.

According to this aspect of the present invention, the laminated structure is adopted in which the hydrogen contents are respective changed in the layers, and therefore manufacture can be readily achieved.

It is also preferable that the fluorine-containing DLC film has a gradient composition in which the hydrogen content gradually decreases from the ejection surface of the nozzle plate toward the interior of the nozzle plate.

According to this aspect of the present invention, since the change in the hydrogen content in the fluorine-containing DLC film has a gradient, then it is possible to disperse stress, which may occur in boundaries between layers of different hydrogen contents in a film of laminated structure. Consequently, the mechanical strength can be improved.

It is also preferable that the protruding and recessing structure is formed in a nozzle plate substrate, and the fluorine-containing DLC film is formed on the nozzle plate substrate.

According to this aspect of the present invention, since the protruding and recessing structure is formed in the nozzle plate substrate, processing can be carried out more readily compared to a case where a protruding and recessing structure is formed in a DLC film.

In order to attain the aforementioned object, the present invention is also directed to a method of manufacturing a droplet ejection head, comprising the steps of: forming a fluorine-containing DLC film on a substrate; then forming a protruding and recessing structure in the fluorine-containing DLC film; and then forming a nozzle aperture by perforating the substrate and the fluorine-containing DLC film.

According to this aspect of the present invention, since the fluorine-containing DLC film is formed on the substrate, and the protruding and recessing structure is formed in the fluorine-containing DLC film, then it is possible to improve the liquid repelling properties and the mechanical durability of the manufactured droplet ejection head.

Preferably, in the step of forming the fluorine-containing DLC film, an amount of added hydrogen in the fluorine-containing DLC film is controlled by changing a flow rate of gas serving as a hydrogen source.

According to this aspect of the present invention, it is possible to control the amount of added hydrogen in the fluorine-containing DLC film by changing the flow rate of gas serving as the hydrogen source, and therefore the amount of added hydrogen can be readily controlled.

In order to attain the aforementioned object, the present invention is also directed to a method of manufacturing a droplet ejection head, comprising the steps of: forming a protruding and recessing structure on a substrate; then forming a fluorine-containing DLC film on the substrate; and then forming a nozzle aperture by perforating the substrate and the fluorine-containing DLC film.

According to this aspect of the present invention, since the protruding and recessing structure is formed in the substrate, then it is possible to readily carry out processing of the protruding and recessing structure.

According to the droplet ejection head and the method of manufacturing the droplet ejection head according to the present invention, it is possible to satisfactorily achieve both the mechanical durability and the durability of the liquid repelling function of the surface of the nozzle plate.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Inkjet heads are hereby described by way of example of a droplet ejection head according to an embodiment of the present invention.

Figure 1:
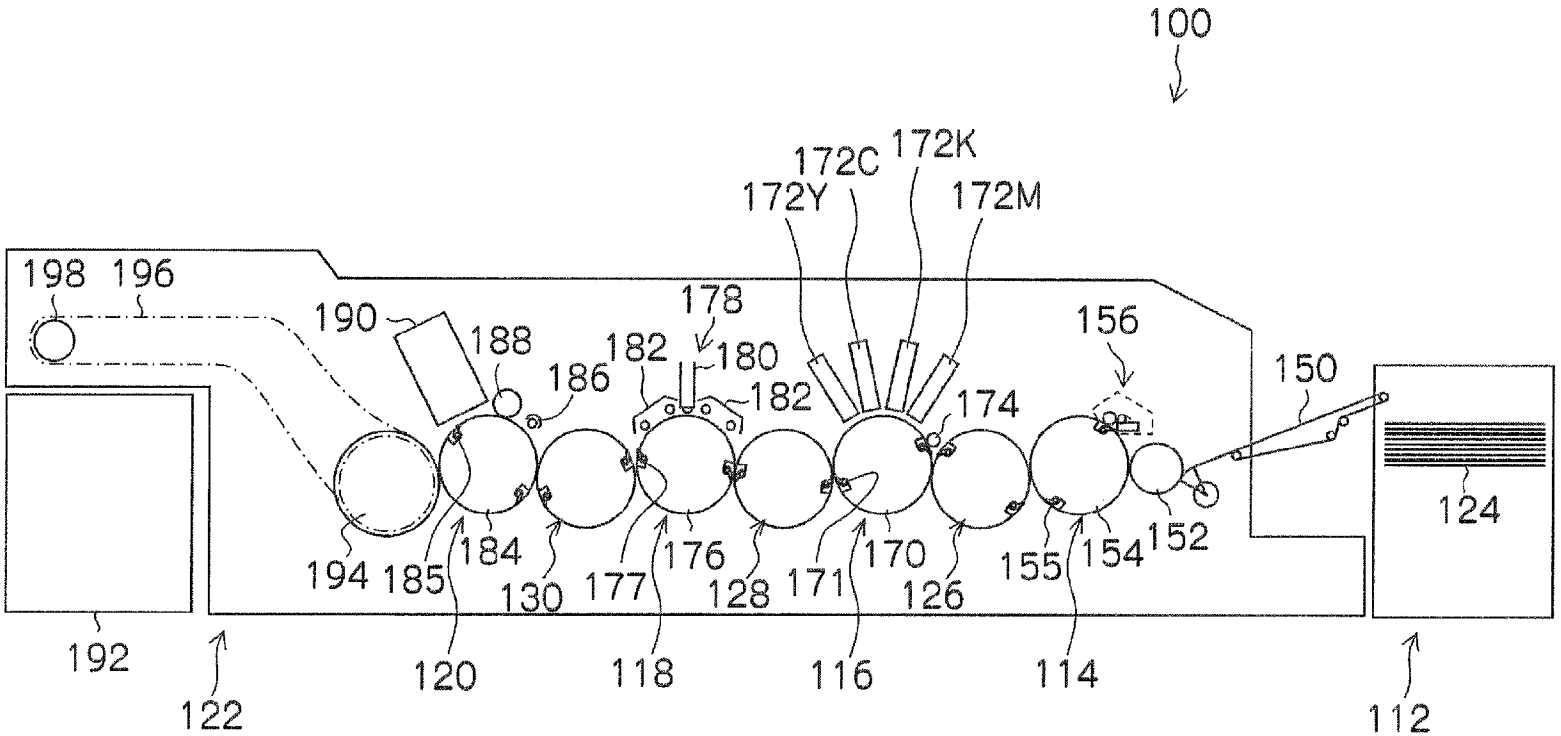
FIG. 1 is a general schematic drawing showing a general view of an inkjet recording apparatus.

FIG. 1 is a diagram showing the composition of an inkjet recording apparatus provided with the inkjet heads. The inkjet recording apparatus 100 uses a pressure drum direct image formation method, which forms a desired color image by ejecting and depositing droplets of inks of a plurality of colors from the inkjet heads 172M, 172K, 172C and 172Y onto a recording medium 124 (hereinafter also referred to as "paper" for the sake of convenience) held on a pressure drum (image formation drum 170) of an image formation unit 116. The inkjet recording apparatus 100 is an image forming apparatus of an on-demand type employing a two-liquid reaction (aggregation) method in which an image is formed on the recording medium 124 by depositing a treatment liquid (here, an aggregating treatment liquid) on the recording medium 124 before depositing droplets of the ink, and causing the treatment liquid and the ink liquid to react together.

As shown in FIG. 1, the inkjet recording apparatus 100 includes a paper feed unit 112, a treatment liquid deposition unit 114, the image formation unit 116, a drying unit 118, a fixing unit 120 and a paper output unit 122.

<Paper Supply Unit>

The paper supply unit 112 is a mechanism for supplying the recording medium 124 to the treatment liquid deposition unit 114. The recording media 124, which are cut sheets of paper, are stacked in the paper supply unit 112. The paper supply unit 112 is provided with a paper supply tray 150, and the recording medium 124 is supplied one sheet at a time to the treatment liquid deposition unit 114 from the paper supply tray 150.

<Treatment Liquid Deposition Unit>

The treatment liquid deposition unit 114 is a mechanism which deposits the treatment liquid onto a recording surface of the recording medium 124. The treatment liquid includes a coloring material aggregating agent, which aggregates the coloring material (in the present embodiment, the pigment) in the ink deposited by the image formation unit 116, and the separation of the ink into the coloring material and the solvent is promoted due to the treatment liquid and the ink making contact with each other.

As shown in FIG. 1, the treatment liquid deposition unit 114 includes a paper supply drum 152, a treatment liquid drum 154 and a treatment liquid application device 156. The treatment liquid drum 154 is a drum which holds and conveys the recording medium 124 so as to rotate. The treatment liquid drum 154 has a hook-shaped gripping device (gripper) 155 arranged on the outer circumferential surface thereof, and is devised in such a manner that the leading end of the recording medium 124 can be held by gripping the recording medium 124 between the hook of the holding device 155 and the circumferential surface of the treatment liquid drum 154.

The treatment liquid application device 156 is arranged at the outside of the treatment liquid drum 154 to oppose the circumferential surface of the treatment liquid drum 154. The treatment liquid application device 156 includes: a treatment liquid vessel, in which the treatment liquid is stored; an anilox roller, which is partially immersed in the treatment liquid in the treatment liquid vessel; and a rubber roller, which transfers a dosed amount of the treatment liquid to the recording medium 124, by being pressed against the anilox roller and the recording medium 124 on the treatment liquid drum 154. The treatment liquid application device 156 can apply the treatment liquid to the recording medium 124 while dosing the amount of the applied treatment liquid.

The recording medium 124 onto which the treatment liquid has been deposited by the treatment liquid deposition device 114 is transferred from the treatment liquid drum 154 to the image formation drum 170 of the image formation unit 116 through an intermediate conveyance unit 126.

<Image Formation Unit>

The image formation unit 116 includes the image formation drum (second conveyance member) 170, a paper pressing roller 174, and the inkjet heads 172M, 172K, 172C and 172Y. Similarly to the treatment liquid drum 154, the image formation drum 170 has a hook-shaped holding device (gripper) 171 on the outer circumferential surface thereof. The recording medium 124 held on the image formation drum 170 is conveyed with the recording surface thereof facing to the outer side, and droplets of the ink are deposited onto the recording surface from the inkjet heads 172M, 172K, 172C and 172Y.

The inkjet heads 172M, 172K, 172C and 172Y are desirably full-line type inkjet recording heads (inkjet heads) having a length corresponding to the maximum width of the image forming region on the recording medium 124. A nozzle row of nozzles for ejecting droplets of the ink arranged throughout the whole width of the image forming region is formed in the ink ejection surface of each inkjet head. The inkjet heads 172M, 172K, 172Y and 172Y are disposed so as to extend in a direction perpendicular to the conveyance direction of the recording medium 124 (the direction of rotation of the image formation drum 170).

When droplets of the corresponding colored ink are ejected from the inkjet heads 172M, 172K, 172C and 172Y toward the recording surface of the recording medium 124 which is held tightly on the image formation drum 170, the ink makes contact with the treatment liquid that has previously been deposited on the recording surface by the treatment liquid deposition unit 114, the coloring material (pigment) dispersed in the ink is aggregated, and a coloring material aggregate is thereby formed. By this means, flowing of coloring material, and the like, on the recording medium 124 is prevented and an image is formed on the recording surface of the recording medium 124.

The recording medium 124 on which an image has been formed in the image formation unit 116 is transferred from the image formation drum 170 to a drying drum 176 of the drying unit 118 through an intermediate conveyance unit 128.

<Drying Unit>

The drying unit 118 is a mechanism which dries the water content contained in the solvent that has been separated by the action of aggregating the coloring material, and as shown in FIG. 1, includes the drying drum 176 and a solvent drying device 178.

Similarly to the treatment liquid drum 154, the drying drum 176 has a hook-shaped holding device (gripper) 177 arranged on the outer circumferential surface thereof; in such a manner that the leading end of the recording medium 124 can be held by the holding device 177.

The solvent drying device 178 is disposed in a position opposing the outer circumferential surface of the drying drum 176, and includes a plurality of halogen heaters 182 and a hot air spraying nozzle 180 disposed between the halogen heaters 182.

The recording medium 124 on which a drying process has been carried out in the drying unit 118 is transferred from the drying drum 176 to a fixing drum 184 of the fixing unit 120 through an intermediate conveyance unit 130.

<Fixing Unit>

The fixing unit 120 includes the fixing drum 184, a halogen heater 186, a fixing roller 188 and an in-line sensor 190. Similarly to the treatment liquid drum 154, the fixing drum 184 has a hook-shaped holding device (gripper) 185 arranged on the outer circumferential surface thereof, in such a manner that the leading end of the recording medium 124 can be held by the holding device 185.

By means of the rotation of the fixing drum 184, the recording medium 124 is conveyed with the recording surface facing to the outer side, and preliminary heating by the halogen heater 186, a fixing process by the fixing roller 188 and inspection by the in-line sensor 190 are carried out in respect of the recording surface of the recording medium 124.

In the fixing unit 120, the thermoplastic resin particles in the thin image layer formed by the drying unit 118 are heated, melted and pressed by the fixing roller 188, and hence the image layer can be fixed to the recording medium 124. Moreover, by setting the surface temperature of the fixing drum 184 to not lower than 50° C., drying is promoted by heating the recording medium 124 held on the outer circumferential surface of the fixing drum 184 from the rear surface of the recording medium 124, and therefore breaking of the image during the fixing can be prevented, and furthermore, the strength of the image can be increased by the effects of the increased temperature of the image.

In cases where the ink contains an ultraviolet-curable monomer, after the water has been sufficiently evaporated off in the drying unit, ultraviolet light is irradiated onto the image by a fixing unit having an ultraviolet irradiation lamp, thereby curing and polymerizing the ultraviolet-curable monomer and making it possible to improve the strength of the image.

<Paper Output Unit>

As shown in FIG. 1, the paper output unit 122 is arranged subsequently to the fixing unit 120. The paper output unit 122 includes an output tray 192, and a transfer drum 194, a conveyance belt 196 and a tensioning roller 198 are arranged between the fixing drum 184 of the fixing unit 120 and the output tray 192 so as to oppose them. The recording medium 124 is sent to the conveyance belt 196 by the transfer drum 194 and output to the output tray 192.

Furthermore, although not shown in FIG. 1, the inkjet recording apparatus 100 in the present embodiment includes, in addition to the above-described components, an ink storing and loading unit, which supplies ink to the inkjet heads 172M, 172K, 172C and 172Y; a device which supplies the treatment liquid to the treatment liquid deposition unit 114; a head maintenance unit, which carries out cleaning (nozzle surface wiping, purging, nozzle sucking, and the like) of the inkjet heads 172M, 172K, 172C and 172Y; a position determination sensor, which determines the position of the recording medium 124 in the paper conveyance path; a temperature sensor, which determines the temperature of the respective units of the apparatus, and the like.

The inkjet recording apparatus 100 based on the drum conveyance system has been described with reference to FIG. 1, but the present invention is not limited to this and can also be used in an inkjet recording apparatus based on a belt conveyance system, or the like.

<Structure of Inkjet Head>

Next, the structure of the inkjet heads 172M, 172K, 172C and 172Y is described. Here, the respective heads 172M, 172K, 172C and 172Y have the same structure, and any of the heads is hereinafter denoted with a reference numeral 250.

Figure 2A:
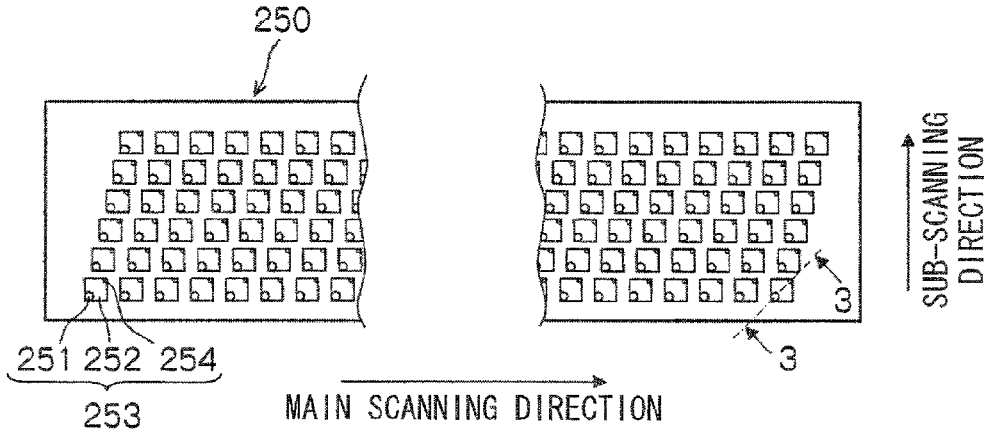
FIGS. 2A and 2B are plan view perspective diagrams showing examples of the structure of inkjet heads.
Figure 2B:
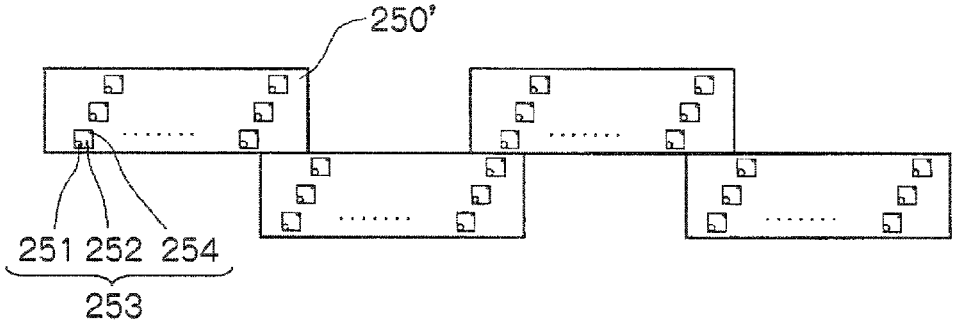
Figure 3:
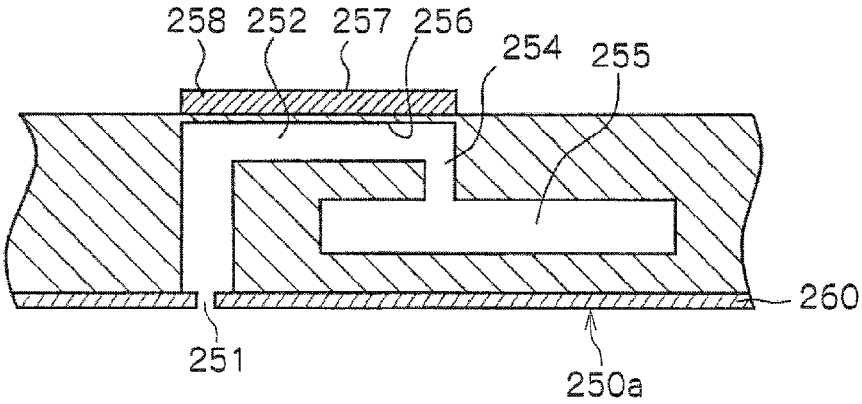
FIG. 3 is a cross-sectional diagram along line 3-3 in FIG. 2A.

FIG. 2A is a plan view perspective drawing showing an example of a structure of an inkjet head 250, and FIG. 2B is a plan view perspective drawing showing a further example of a structure of an inkjet head. FIG. 3 is a cross-sectional diagram showing the inner structure of an ink chamber unit (a cross-sectional diagram along line 3-3 in FIG. 2A).

In order to achieve a high density of the dots fanned on the surface of the recording paper, it is necessary to achieve a high density of the nozzles in the inkjet head 250. As shown in FIG. 2A, the inkjet head 250 in the present embodiment has a structure in which a plurality of ink chamber units 253 are arranged in a staggered matrix configuration (two-dimensional configuration), each ink chamber unit 253 being constituted of a nozzle 251, which is an ink droplet ejection aperture, and a pressure chamber 252 corresponding to the nozzle 251, and the like. Accordingly, the effective nozzle pitch projected to an alignment in the lengthwise direction of the head (the main scanning direction perpendicular to the paper conveyance direction) (namely, the projected nozzle pitch) can be minimized.

An embodiment constituting one or more nozzle rows covering a length corresponding to the full width of the recording medium 124 in a direction substantially perpendicular to the paper conveyance direction is not limited to the present embodiment. For example, instead of the composition in FIG. 2A, as shown in FIG. 2B, a line head having nozzle rows of a length corresponding to the entire width of the recording medium 124 can be formed by arranging and combining, in a staggered matrix, short head blocks (head chips) 250' each having a plurality of nozzles 251 arrayed in a two-dimensional fashion. Furthermore, although not shown in the drawings, it is also possible to form a line head by aligning short heads in a row.

As shown in FIG. 3, the nozzles 251 are formed in a nozzle plate 260, which constitutes an ink ejection surface 250*a* of the inkjet head 250. As described below, the nozzle plate 260 is formed by stacking fluorine-doped DLC (hereinafter referred to as "F-DLC") onto a substrate of a silicon material, such as Si, $SiO_2$, SiN or quartz glass, for example, and is formed with a protruding and recessing structure on the surface thereof. By using F-DLC and forming the protruding and recessing structure on the surface thereof, liquid repelling properties are imparted to the surface of the nozzle plate 260 and adherence of ink is prevented.

The pressure chambers 252 are arranged correspondingly to the nozzles 251. Each of the pressure chambers 252 is formed with a substantially square planar shape, and a nozzle 251 and a supply port 254 are arranged in the respective corner portions on a diagonal of this planar shape. The pressure chambers 252 connect with a common flow channel 255 through the respective supply ports 254. The common flow channel 255 is connected to an ink supply tank (not shown), which forms an ink supply source, and the ink supplied from the ink supply tank is distributed through the common flow channel 255 to the pressure chambers 252.

Piezoelectric elements 258 are bonded to a diaphragm 256, which constitutes ceiling faces of the pressure chambers 252 and also serves as a common electrode. Each of the piezoelectric elements 258 has an individual electrode 257, and is deformed by being applied with a drive voltage to the individual electrode 257, thereby causing the ink in the corresponding pressure chamber 252 to be ejected through the nozzle 251. When the ink is ejected, new ink is supplied to the pressure chamber 252 from the common flow channel 255 through the supply port 254.

The arrangement structure of the nozzles is not limited to the example shown in the drawings, and it is also possible to apply various other types of nozzle arrangements, such as an arrangement structure having one nozzle row in the sub-scanning direction.

Furthermore, the present invention is not limited to a printing system based on a line type of head, and it is also possible to adopt a serial system where a short head which is shorter than the breadthways dimension of the recording medium 124 is moved in the breadthways direction (main scanning direction) of the recording medium 124, thereby performing printing in the breadthways direction, and when one printing action in the breadthways direction has been completed, the recording medium 124 is moved through a prescribed amount in the direction perpendicular to the breadthways direction (the sub-scanning direction), printing in the breadthways direction of the recording medium 124 is carried out in the next printing region, and by repeating this sequence, printing is performed over the whole surface of the printing region of the recording medium 124.

Method for Manufacturing Nozzle Plate

First Embodiment

FIGS. 4A to 4J show a method of manufacturing a nozzle plate which is used in the droplet ejection head according to an embodiment of the present invention. The formation and structuring of an F-DLC film is hereby described with reference to FIGS. 4A to 4D.

Figure 4A:
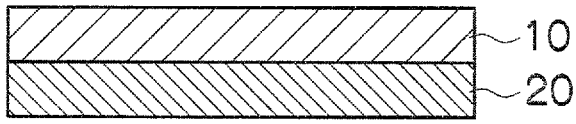
FIGS. 4A to 4J are diagrams showing steps of a method of manufacturing an inkjet head according to a first embodiment of the present invention.

Step 1: An F-DLC film 20 is formed on a substrate 10, as shown in FIG. 4A. For the substrate 10, it is possible to use a silicon material, such as Si, $SiO_2$, SiN, or quartz glass. In the present embodiment, a 6-inch silicon wafer is used for the substrate 10.

The F-DLC film 20 is formed by sputtering on the substrate 10 (on a mirror surface of the silicon wafer). A conventional sputtering apparatus can be used for the film formation. Fluorine-containing carbon material is used as the material substance (target), and methane ($CH_4$) mixed to argon (Ar) is introduced as a hydrogen source.

The F-DLC film 20 is formed after cleaning the surface of the substrate 10 with Ar gas. Desirably, the temperature of the substrate 10 is room temperature to 500° C. and the degree of vacuum is 0.1 Pa to 1 Pa. The hydrogen content in the F-DLC film 20 can be controlled to 0 to 40 at. % (atomic percent) by controlling the flow ratio of $CH_4$ gas with respect to (Ar+$CH_4$) gas to a range of 0 to 50%. In the present embodiment, the hydrogen content in the F-DLC film 20 is controlled to 20 at. %. Furthermore, desirably, the amount of fluorine in the F-DLC film 20 is set such that F/(F+C) is larger than 0 at. % and not larger than 40 at. %. Moreover, the thickness of the F-DLC film 20 is desirably in the range of 100 nm to 2 μm. In the present embodiment, the thickness of the F-DLC film 20 is taken to be 500 nm.

Figure 4B:
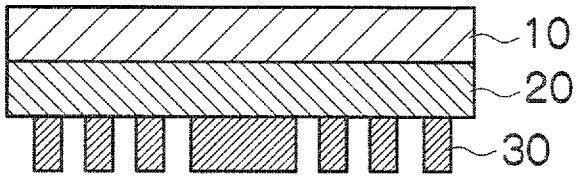

Step 2: A mask 30 is then patterned on the F-DLC film 20 as shown in FIG. 4B. The material used for the mask 30 can be Cr, W, Pr, Ir, or an organic resist. In the present embodiment, Cr is used for the mask 30.

Firstly, a film of the material of mask 30 is formed to a thickness of 500 nm by vapor deposition. Thereupon, the mask 30 is patterned on the F-DLC film 20 by lithography using a photoresist, so as to correspond to the pattern of a protruding and recessing structure 40 that is to be formed in the succeeding Step 3. It is desirable that the pattern shape is a dot pattern, the size of each dot is 200 nm to 1 μm square, and the pitch between the dots is 200 nm to 1 μm. In the present embodiment, the dot size is 200 nm and the dot pitch is 200 nm.

As a method for patterning the mask 30, apart from the lithography method by exposure of a resist with a stepper, it is also possible to employ an electron beam direct image formation method or a nano-imprinting method, or the like.

Figure 4C:
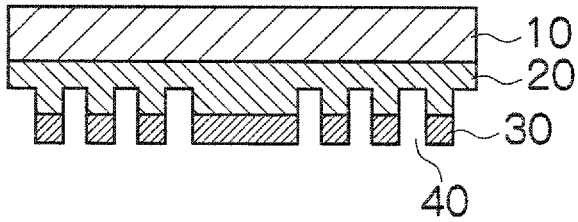

Step 3: The F-DLC film 20 is then patterned as shown in FIG. 4C. The patterning of the F-DLC film 20 can be carried out by dry etching. A mixed gas of $CF_4$, $O_2$ and Ar is used as the etching gas, a plasma is generated by applying a high-frequency electric field of 14 MHz and 650 W, and etching is performed by causing $CF_4$ gas and $O_2$ gas to react with the F-DLC film 20. The processing depth of the F-DLC film 20 can be controlled by the etching time, and desirably is 50 nm to 500 nm. In the present embodiment, the processing depth of the F-DLC film 20 is 250 nm.

Figure 4D:
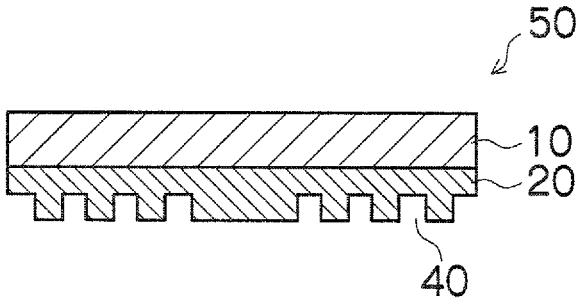

Step 4: The mask 30 is then removed as shown in FIG. 4D. The mask 30 can be removed by immersion in an etching liquid. In the present embodiment, since Cr is used as the material of the mask 30, and the mask 30 is removed by immersion in an etching liquid containing eerie ammonium nitrate.

An F-DLC structure 50 obtained in this way has the F-DLC film 20 provided with the protruding and recessing structure 40 having the dot size of 200 nm to 1 μm square, the dot pitch of 200 nm to 1 μm, and the depth of recessions (or the height of protrusions) of 50 nm to 500 nm. In the present embodiment, the dot size is 200 nm, the dot pitch is 200 nm, and the depth of recessions is 250 nm.

Figure 4E:
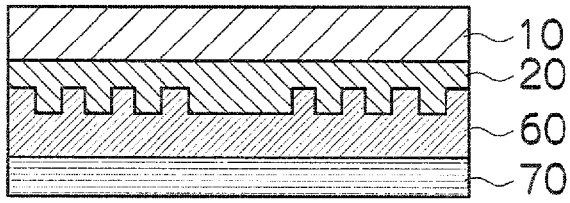

Step 5: A nozzle aperture processing step is described with reference to FIGS. 4E to 4J. As shown in FIG. 4E, a thick layer of resist 60 and a material of mask 70 are stacked on the F-DLC film 20 of the F-DLC structure 50 that has been structured as described above. The thick layer of resist 60 can be formed by application, and the material of mask 70 can be formed by vapor deposition. In the present embodiment, Cr is used as the material of mask 70. A fainting method similar to a conventional method can be used. In the present embodiment, the film thicknesses of the respective layers are: 5 μm for the thick layer of resist 60, and 500 nm for the material of mask 70.

Figure 4F:
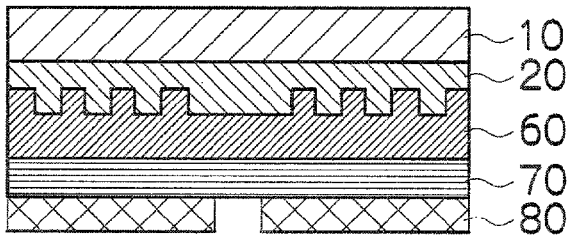

Step 6: A resist mask 80 corresponding to a nozzle aperture processing section is then formed as shown in FIG. 4F by lithography. The film thickness of the resist mask 80 is 200 nm, and the nozzle pattern has a diameter of 20 μm.

Figure 4G:
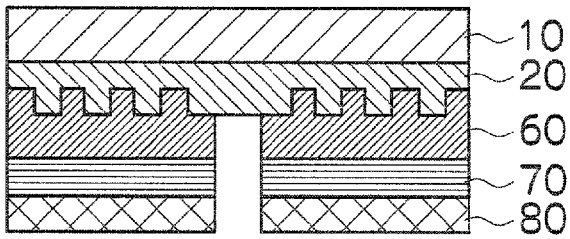

Step 7: A pattern mask corresponding to the nozzle aperture processing section is then formed as shown in FIG. 4G. The pattern mask is formed by patterning the thick layer of resist 60 and the material of mask 70 by dry etching. It is possible to pattern only the thick layer of resist 60 and the mask 70, using the F-DLC film 20 as an etching stopper, by dry etching in which $CF_4$ gas is introduced.

Figure 4H:
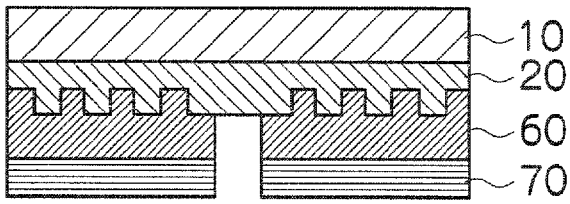

Step 8: By removing the resist mask 80 left on the mask 70 after the end of dry etching, the pattern mask for nozzle aperture processing is formed as shown in FIG. 4H.

Figure 4I:
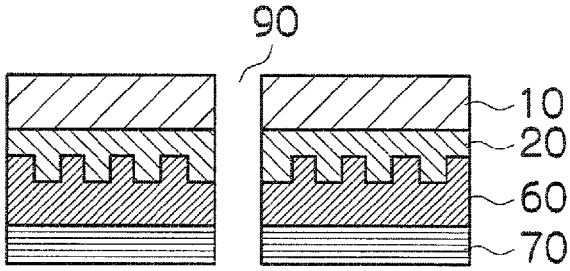

Step 9: A nozzle aperture 90 is then formed as shown in FIG. 4I. The nozzle aperture 90 is formed by perforating the F-DLC film 20 and the substrate 10 by reactive ion etching (RIE), using the pattern mask constituted of the thick layer of resist 60 and the mask 70.

A mixed gas of $CF_4$, $O_2$ and Ar is used as the etching gas, a plasma is generated by applying a high-frequency electric field of 14 MHz and 650 W, and the etching is performed by causing $CF_4$ gas and $O_2$ gas to react with the F-DLC film 20. Furthermore, a flow channel structure (not shown) is formed on a side of the substrate 10 opposite to the F-DLC film 20, and the nozzle apertures 90 and the flow channel structure are connected together by removing the corresponding portions of the substrate 10 by dry etching.

Figure 4J:
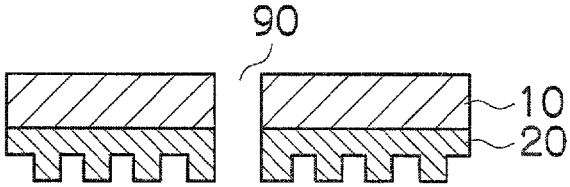

Step 10: The thick layer of resist 60 and the mask 70 left on the F-DLC film 20 are then removed as shown in FIG. 4J by immersion in a resist removal solvent or chemical, by a lift-off method. It is also possible to adopt a method in which the mask 70 is removed by immersion in an etching liquid (in the present embodiment, a Cr etching liquid), and then the thick layer of resist 60 is removed by an organic solvent.

The thus formed nozzle plate is made of the material that uses fluorine-doped DLC in the surface of the nozzle plate, and therefore the mechanical durability of the nozzle plate can be improved. Furthermore, since water repelling properties are imparted to the surface of the nozzle plate by doping with fluorine, there is no need to additionally form a water repelling film by means of an organic water-repelling material. Consequently, detachment of water repelling film and deterioration in water repelling function thereby caused do not occur, and it is thus possible also to improve the durability of the water repelling function.

Second Embodiment

Figure 5A:
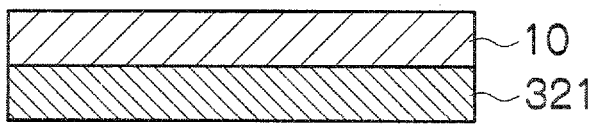
FIGS. 5A to 5C are diagrams showing steps of film formation and structuring of an inkjet head according to a second embodiment of the present invention.
Figure 5B:
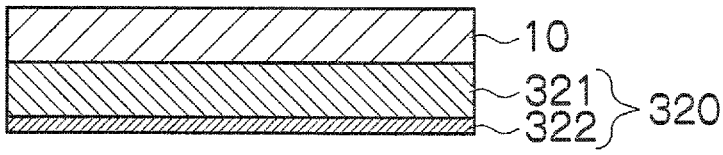
Figure 5C:
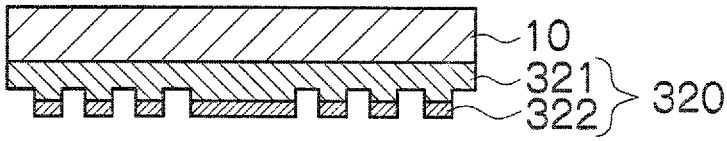

FIGS. 5A to 5C are diagrams for describing a method of manufacturing a nozzle plate according to a second embodiment of the present invention. The nozzle plate in the second embodiment differs from the first embodiment in that the density of the F-DLC film is changed by changing the amount of added hydrogen when forming the F-DLC film.

The hydrogen content in the F-DLC film can be controlled to 0 to 40 at. % by controlling the flow rate ratio of $CH_4$ gas with respect to ($Ar+CH_4$) gas to a range of 0 to 50% during formation of the F-DLC film. In the F-DLC film of a first layer 321 (the silicon substrate side) shown in FIG. 5A, the amount of added hydrogen is reduced, the density and hardness are increased and the mechanical durability is improved. Thereupon, in the F-DLC film of a second layer 322 shown in FIG. 5B, the amount of added hydrogen is increased, and the slidability with respect to a wiping action is improved.

Figure 6:
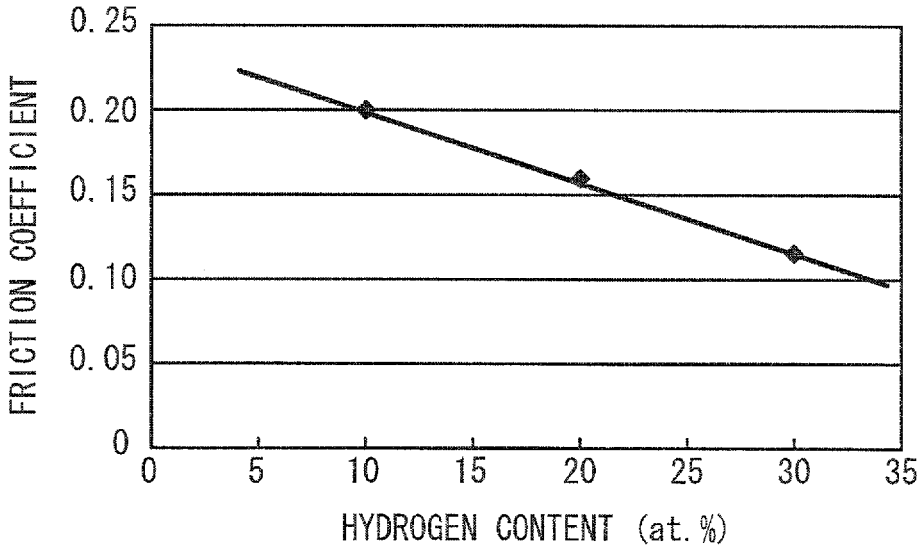
FIG. 6 is a graph showing the relationship between the hydrogen content in an F-DLC film and the friction coefficient.

FIG. 6 shows a graph of the relationship between the hydrogen content in the DLC film and the friction coefficient. The hydrogen content can be measured by Raman microscopy. As shown in FIG. 6, the friction coefficient of the DLC film is 0.10 when the hydrogen content in the DLC film is 35 at. %, and the friction coefficient is 0.20 when the hydrogen content is 10 at. %; then it is thought that the friction coefficient is reduced and the slidability is improved by raising the hydrogen content. Furthermore, the hardness of the DLC film is 10 GPa when the hydrogen content in the DLC film is 35 at. %, and the hardness is 20 GPa when the hydrogen content is 10 at. %; then the hardness is improved by reducing the hydrogen content.

The strength and slidability of the DLC film can be controlled by varying the doping amount of hydrogen in the DLC film. By reducing the hydrogen doping amount, the ratio of $sp^3$ bonded carbon atoms of diamond structure increases, it is possible to raise the density, but the slidability becomes worse. Conversely, by increasing the hydrogen doping amount, the ratio of graphitic $sp^2$ bonded carbon atoms increases, and therefore the density declines, but the slidability improves. Consequently, it is sought to improve the wear resistance by raising the hydrogen doping amount only in the surface of the F-DLC film (protruding and recessing structure), and thereby improving the slidability. Moreover, by reducing the hydrogen doping amount and thus raising the hardness and mechanical strength on the substrate side of the F-DLC film (protruding and recessing structure), it is possible to increase the strength of the nozzle plate and the protruding and recessing structure itself, and therefore destruction of the protruding and recessing structure by the wiping action can be prevented and the wear resistance can be improved. On the other hand, the water repelling properties depend on the fluorine doping amount. Consequently, the water repelling properties of the F-DLC film are controlled by the fluorine doping amount, and the density (hardness, slidability) of the F-DLC film is controlled by the hydrogen doping amount.

In the present embodiment, an F-DLC layer having the amount of added hydrogen of 10 at. % is formed as the first layer 321 to a film thickness of 400 nm onto the substrate 10, using a 3% flow ratio of $CH_4$ gas to ($Ar+CH_4$) gas; an F-DLC film having the amount of added hydrogen of 35 at. % is formed as the second layer 322 to a film thickness of 100 nm onto the first layer 321 formed on the substrate 10, using a 40% flow ratio of $CH_4$ gas with respect to ($Ar+CH_4$) gas; and thereby an F-DLC film 320 having the two-layered structure is formed. Each of the first and second F-DLC layers 321 and 322 has a fluorine amount F/(F+C) of 40 at. %.

In the foregoing description, the F-DLC film is formed as the two-layered structure in which the amount of added hydrogen is changed; however, it is also possible to adopt a laminated F-DLC film having three or more layers in which the amount of added hydrogen is gradually increased from the substrate side.

Furthermore, it is also possible to adopt a continuously formed F-DLC film having a gradient composition in which the amount of added hydrogen is increased from the substrate side toward the surface. More specifically, the flow ratio of $CH_4$ gas with respect to ($Ar+CH_4$) gas is firstly set to 3% such that the amount of added hydrogen is set to 10 at. % for formation of an F-DLC film, then the flow ratio of $CH_4$ gas is gradually increased during the film formation until finally reaching 40%, whereby the F-DLC film having a gradient composition with the greatest amount of added hydrogen at the surface of the F-DLC film can be obtained. By adopting a gradient composition of this kind, it is possible to disperse stress, which may occur in boundaries between layers of different properties in a laminated structure, and thus a strong film can be manufactured.

As shown in FIG. 5C, the F-DLC film 320 is subjected to a structuring process by a method similar to that of the first embodiment, and a nozzle plate is then manufactured by forming nozzle apertures.

The nozzle plate formed as described above has a lower amount of added hydrogen and therefore higher density and hardness and greater mechanical durability, in the base portions of the protrusions in the protruding and recessing structure of the F-DLC film 320; and has a higher amount of added hydrogen and therefore lower friction coefficient and greater wiping slidability and wear resistance, in the surface portions of the protruding and recessing structure of the F-DLC film 320. Thus, it is possible to achieve both high hardness and high strength of the protruding and recessing structure and great slidability on the surface of the protruding and recessing structure.

Third Embodiment

Figure 7A:
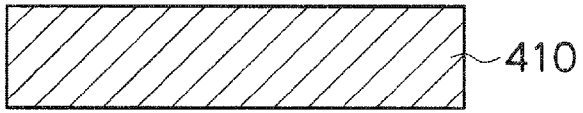
FIGS. 7A to 7C are diagrams showing steps of film formation and structuring of an inkjet head according to a third embodiment of the present invention.
Figure 7B:
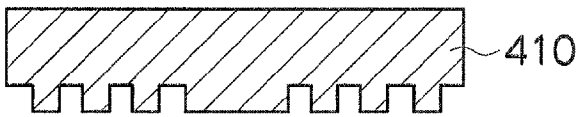
Figure 7C:
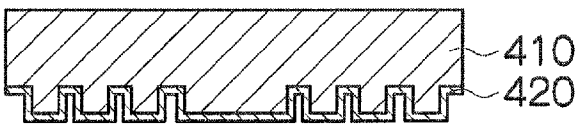

FIGS. 7A to 7C are diagrams for describing a method of manufacturing a nozzles plate according to a third embodiment of the present invention. The method in the third embodiment differs from the first and second embodiments in that the surface of a silicon substrate 410 is coated with an F-DLC film 420 after being formed with a protruding and recessing structure.

In the third embodiment, the substrate 410 shown in FIG. 7A is firstly structured. A protruding and recessing structure is formed on the substrate 410 as shown in FIG. 7B by dry etching through patterning a resist on the substrate 410. It is possible to use a silicon material similar to the embodiments described above as the substrate 410, and in the present embodiment, a 6-inch silicon wafer is used. Dry etching can be carried out using $Ar+CF_4$ gas, for example, at a substrate temperature of room temperature to 500° C., and a degree of vacuum of 0.1 Pa to 1 Pa. The processing depth of the protruding and recessing structure can be controlled by controlling the etching time. When a silicon-on-insulator (SOI) substrate is used, then the processing depth can be controlled by using an embedded oxide film ($SiO_2$ film) arranged in the SOI substrate as an etching stopper. Desirably, the pattern shape of the protruding and recessing structure is a dot pattern, the size of each dot is 200 nm to 1 μm square, and the pitch between the dots is 200 nm to 1 μm. In the present embodiment, the dot size is 200 nm, the dot pitch is 200 nm, and the processing depth is 300 nm.

Next, as shown in FIG. 7C, the F-DLC film 420 is formed by sputtering on the substrate 410 on which the protruding and recessing structure has been formed. The method of forming the F-DLC film 420 can employ a similar method to that used to form the F-DLC film 20 in Step 1 of the first embodiment, and for example, fluorine-containing carbon material is used as a target, and $CH_4$ mixed to Ar is used as a hydrogen source. By setting the substrate temperature to room temperature to 500° C. and the degree of vacuum to 0.1 Pa to 1 Pa, and changing the ratio of $CH_4$ gas with respect to ($Ar+CH_4$) gas in a range of 0 to 50%, the hydrogen content in the F-DLC film 420 is controlled in a range of 0 to 40 at. %. In the present embodiment, the hydrogen content in the F-DLC film 420 is set to 20 at. %, the amount of fluorine in the F-DLC film 420 is set such that F/(F+C) is 40 at. %, and the thickness of the F-DLC film 420 is 50 nm.

A nozzle plate is manufactured by forming nozzle apertures by a similar method to the first embodiment, in the substrate 410 on which the F-DLC film 420 has been formed as described above.

According to the present embodiment, the surface of the nozzle plate is coated with the F-DLC film, which achieves both mechanical durability and durability of the water repelling function. Moreover, since the protruding and recessing structure is formed on the silicon substrate, then it can be formed readily compared to the processing with respect to DLC. Furthermore, when forming the nozzle apertures also, since the thickness of the F-DLC film is small, then it is possible to readily form the nozzle apertures, for instance, the etching time can be shortened.

However, when compared with the nozzle plate according to the first or second embodiment, since the base portions of the protrusions in the protruding and recessing structure are formed of silicon and the F-DLC film is thin in the third embodiment, then the mechanical strength and water repelling function tend to be low. Consequently, the nozzle plate according to the third embodiment is desirably used in combination with a non-contact maintenance method in which wiping is not carried out and the relatively low wear resistance is acceptable.

Figure 8A:
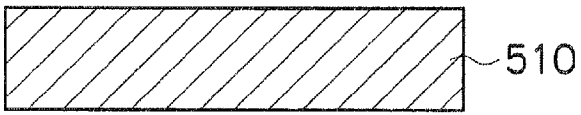
FIGS. 8A to 8C are diagrams showing steps of film formation and structuring of an inkjet head according to a further embodiment of the present invention.
Figure 8B:
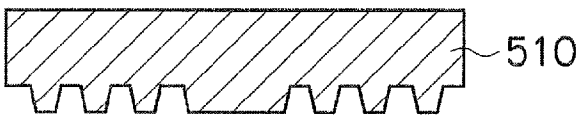
Figure 8C:
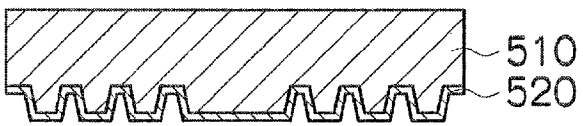

The protruding and recessing structure of the substrate 410 is foamed perpendicularly with respect to the substrate 410 in FIG. 7B; however, a protruding and recessing structure can be formed on a substrate 510 as shown in FIG. 8B, in which each protrusion is formed in a trapezoidal shape and each recession becomes wider toward the surface of the substrate 510. The substrate 510 in FIG. 8A is structured to have the protruding and recessing structure shown in FIG. 8B, and the structured substrate 510 is coated with an F-DLC film 520 as shown in FIG. 8C. By adopting the trapezoidal shape of the protrusions, the openings of the recessions can be broadened, and the coating properties of the F-DLC film can be improved. Furthermore, since the base portions of the protrusions can be made relatively thick, it is possible to improve the mechanical durability.

The methods of fainting the protrusions of the trapezoidal shape include a method in which the gas ratio and/or the plasma intensity during the dry etching is changed, and a method which employs wet etching with buffered hydrofluoric acid, or the like, after the dry etching.

EXAMPLES

Practical Example 1

Water Repelling Properties

A nozzle plate was manufactured by the method according to the first embodiment, and the static contact angles of ink and water on the nozzle plate were measured. As comparative examples, flat F-DLC films having no protruding and recessing structure and the fluorine contents being varied were manufactured, and the static contact angle of ink on each of the flat F-DLC films was measured.

Figure 9:
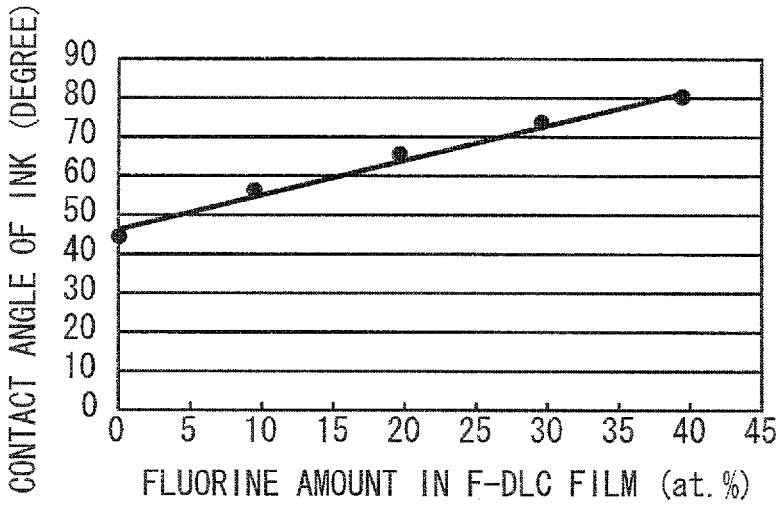
FIG. 9 is a graph showing the relationship between the fluorine content in an F-DLC film and the contact angle of ink.

FIG. 9 shows the measurement results for the static contact angle of ink on the flat F-DLC films Desirably, the static contact angle of ink is not smaller than 60°, from the viewpoint of the ink ejection behavior and the wipability of the ink having adhered to the nozzle surface. Therefore, desirably, the amount of added fluorine in the F-DLC film is not less than 20%, and more desirably, not less than 30%. By ensuring the contact angle of 60° or above, the probability of ink adhering to the nozzle portions or the nozzle surface is reduced, and stable behavior of the ink ejection can be achieved. If ink adheres to the nozzle portions, then this leads to deflection of the ejection direction of the ink and due to solidification of the ink as a result of drying and increase in viscosity, the ink adhering to the nozzle surface readily gives rise to nozzle blockages during maintenance tasks such as wiping. If fluorine is added at a rate of 50% or greater, the F-DLC structure becomes instable and the density thereof falls, which means that the mechanical strength declines, and therefore it is desirable for the amount of added fluorine to be less than 50%.

With respect to the structured nozzle plate having the F-DLC film (amount of added fluorine: 40%) according to the present invention, the contact angle of water was 135° and the contact angle of ink was 95°, and it was then confirmed that water repelling characteristics were raised by imparting the protruding and recessing structure to the nozzle plate surface.

Wear Resistance

The wear resistance was evaluated by deterioration in the static contact angle occurring after wiping the nozzle surface with cloth (TORAYSEE® made by Toray Industries) soaked with an ink cleaning liquid mixed with ink at a concentration of 5%. The wiping pressure was 30 kPa. The evaluation was made by taking the lifespan to be the point at which the contact angle became 60° or lower.

As Comparative Example 1, a specimen was manufactured in which the protruding and recessing structure was imparted to a silicon substrate, and the surface thereof was coated with a water repelling film (OPTOOL® DSX made by Daikin Industries). As Comparative Example 2, a specimen was manufactured in which the protruding and recessing structure was imparted to a DLC film that was not doped with fluorine, and the surface thereof was coated with a water repelling film (OPTOOL® DSX). The structuring of each of the silicon substrate and the DLC film in Comparative Examples 1 and 2 was achieved by a combination of a mask pattern and $CF_4$ dry etching, similarly to Practical Example 1. The water repelling film was formed to a thickness of approximately 5 nm to 10 nm by vapor deposition, on each of the silicon substrate and the DLC film in Comparative Examples 1 and 2. By forming the water repelling film, the static contact angle of water was 110° and the static contact angle of ink was 80° in each of Comparative Examples 1 and 2, and thus the contact angles substantially similar to those in Practical Example 1 were able to be obtained.

When the wear resistance was evaluated in Practical Example 1 and Comparative Examples 1 and 2, the wear life span in Practical Example 1 was 20,000 wipes after that the contact angle of ink became 60° or less, the protrusions in the protruding and recessing structure were destroyed after several hundred wipes in Comparative Example 1, and the contact angle of ink fell to 60° or less after 9,500 wipes in Comparative Example 2.

In Comparative Example 1, the mechanical durability of the protruding and recessing structure itself was weak since the structure was made of silicon; and in Comparative Example 2, the structure had mechanical durability due to being made of DLC, but the wear resistance was poor because the surface was made of the water repelling film of organic fluoro-resin. In Practical Example 1 according to the embodiment of the present invention, it was possible to sufficiently achieve both mechanical durability and wear resistance of the water repelling function.

Practical Example 2

A nozzle plate having a two-layered structure with varying amounts of added hydrogen was manufactured by the method according to the second embodiment. The size of the protruding and recessing structure was similar to that of the second embodiment. The fluorine doping amount was 40%. The amounts of added hydrogen were 10 at. % in the first layer and 35 at. % in the second layer. With respect to the thus manufactured nozzle plate, the static contact angle of water was 135° and the static contact angle of ink was 95°, which were the same values as Practical Example 1 (having the single-layered F-DLC film).

When the wear resistance was evaluated by the similar method to that of Practical Example 1, the wear lifespan was 28,000 wipes in Practical Example 2. This is thought to be because the slidability was improved by setting the amount of added hydrogen in the surface of the nozzle plate to 35 at. % in Practical Example 2.

Figure 10:
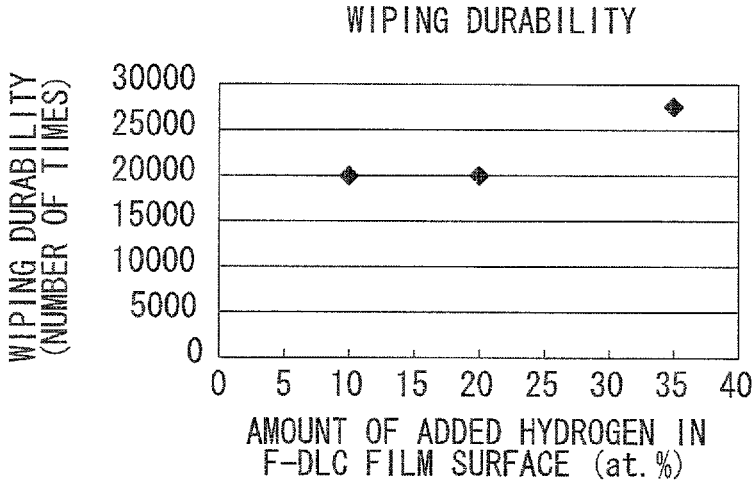
FIG. 10 is a graph showing the relationship between the hydrogen content in an F-DLC film and wiping durability.

FIG. 10 shows the wiping durability when the amount of added hydrogen in the second layer was changed to 10 at. %, 20 at. % and 35 at. % while the amount of added hydrogen in the first layer was fixed at 10 at. %. It could be confirmed that by increasing the amount of added hydrogen in the second layer, the wiping durability was improved.

Practical Example 3

A nozzle plate was manufactured by the method according to the third embodiment. A silicon substrate on which a protruding and recessing structure had been formed was coated with an F-DLC film having an doped fluorine rate of 40% and a thickness of 50 nm. With respect to the thus manufactured nozzle plate, the static contact angle of water was 135° and the static contact angle of ink was 95°, which were the same values as Practical Examples 1 and 2.

When the wear resistance was evaluated by the similar method to that of Practical Example 1, the wear lifespan was 10,000 wipes in Practical Example 3. Since the base portions of the protrusions in the protruding and recessing structure were made of silicon, then the mechanical strength was inferior to that of Practical Examples 1 and 2 but was of a satisfactory level. Furthermore, the water repelling properties also tended to be lower than in Practical Examples 1 and 2, due to the thinness of the F-DLC film, but were also of a satisfactory level.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet ejection head, comprising:

a nozzle plate which has a nozzle aperture for ejecting droplets of liquid;

a flow channel structure including a pressure chamber which contains the liquid and is connected to the nozzle aperture through a flow channel; and a pressure generating element which applies pressure to the liquid in the pressure chamber, wherein an ejection surface of the nozzle plate where the droplets of the liquid are ejected is made of a fluorine-containing DLC (diamond-like carbon) film, the nozzle plate is constituted of a flat substrate and the fluorine-containing DLC film formed onto the flat substrate, wherein the ejection surface of the nozzle plate has a protruding and recessing structure caused by a protruding and recessing structure of the fluorine-containing DLC film, and wherein the fluorine-containing DLC film has a laminated structure formed of a plurality of layers and at least one or more of the plurality of layers being formed only on the protruding structure of the fluorine-containing DLC film.

2. The droplet ejection head as defined in claim 1, wherein a fluorine content of the fluorine-containing DLC film is not less than 30%.

3. The droplet ejection head as defined in claim 1, wherein the protruding and recessing structure has a dot shape with a dot size of 200 nm to 1 μm square and a dot pitch of 200 nm to 1 μm.

4. The droplet ejection head as defined in claim 1, wherein a hydrogen content in the fluorine-containing DLC film in protrusions in the protruding and recessing structure decreases from the ejection surface of the nozzle plate toward an interior of the nozzle plate.

5. The droplet ejection head as defined in claim 4, wherein the plurality of layers have different hydrogen contents.

6. The droplet ejection head as defined in claim 4, wherein the fluorine-containing DLC film has a gradient composition in which the hydrogen content gradually decreases from the ejection surface of the nozzle plate toward the interior of the nozzle plate.

* * * * *